US006329615B1

(12) United States Patent
Biquez

(10) Patent No.: US 6,329,615 B1
(45) Date of Patent: Dec. 11, 2001

(54) DEVICE FOR INTERLOCKING THE MANUAL ACTUATION OF A SWITCH WITH THE HELP OF LOCKS

(75) Inventor: François Biquez, Brignais (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/466,068

(22) Filed: Dec. 17, 1999

(30) Foreign Application Priority Data

Dec. 18, 1998 (FR) ..... 98 15978

(51) Int. Cl.[7] ..... H01H 9/26; H01H 9/28
(52) U.S. Cl. ..... 200/43.11; 200/50.32
(58) Field of Search ..... 200/7 R, 17 R, 200/18, 43.01, 43.04, 43.08, 73.11, 43.15, 43.16, 43.19, 50.01, 50.02, 50.09, 50.11, 50.32, 50.37, 50.4, 61.62, 61.64

(56) References Cited

U.S. PATENT DOCUMENTS

| | | | | |
|---|---|---|---|---|
| 2,298,234 | | 10/1942 | Rugg | 200/50 |
| 3,174,003 | * | 3/1965 | Armstrong | 200/44 |
| 3,206,567 | * | 9/1965 | Grimm | 200/44 |
| 3,822,368 | * | 7/1974 | Salzman et al. | 200/11 D |
| 4,280,035 | * | 7/1981 | Settlemire | 235/94 R |
| 5,061,199 | * | 10/1991 | McClead | 439/304 |
| 5,408,213 | * | 4/1995 | Ungarsohn | 340/427 |

FOREIGN PATENT DOCUMENTS

| | | |
|---|---|---|
| 527559 | 7/1927 | (DE) . |
| 1 276 174 | 8/1968 | (DE) . |
| 1 365 484 | 5/1964 | (FR) . |

* cited by examiner

*Primary Examiner*—Michael Friedhofer
(74) *Attorney, Agent, or Firm*—Sughrue, Mion, Zinn, Macpeak & Seas, PLLC

(57) ABSTRACT

An interlock device using locks to prevent manual actuation of a switch having a handle inlet, and to allow the switch to be actuated manually in a certain sequence of operations determined by using keys for the locks, thereby enabling the switch to pass from a first switching position to a second switching position, the device comprising a first lock and a second lock each operable by means of at least one key capable of being withdrawn from the corresponding lock or of being engaged in said lock only when the lock is in its locked position, a set of cams whose rotation is tied to actuation of the switch and which act on the bolts of said locks to prevent the first lock from being operated so long as the second switch is not in its second switching position and to prevent the second lock being operated by its key as soon as the second switch no longer occupies its first switching position, both locks being disposed in such a manner that their respective bolts, when in the advanced position, close the handle inlet of the switch, the bolt of the first lock being in its retracted position and the bolt of the second lock being in its advanced position when the switch is in its first switching position.

8 Claims, 6 Drawing Sheets

DEVICE FOR INTERLOCKING THE MANUAL ACTUATION OF A SWITCH WITH THE HELP OF LOCKS

The invention relates to generator circuits in electricity-producing stations, such as gas turbine installations, for example.

BACKGROUND OF THE INVENTION

Between the generator and the grid transformer which are interconnected by a set of busbars, such circuits include a generator circuit-breaker and switching apparatuses having two or three switching positions, which apparatuses are of the busbar switch and/or of the grounding switch type. Such a generator circuit can also be connected to a starter device via switch apparatus of this type.

Those various switch apparatuses are generally designed to be actuated automatically and electrically under the control of a control center. They must also be designed so as to be capable of being actuated manually by means of a handle in the event of an electricity failure, particularly a failure in the automatic control center. However, to ensure circuit element integrity, it is essential for manual actuation thereof to proceed in application of an accurately-specified procedure.

FIG. 6 is highly diagrammatic and shows an example of a generator circuit comprising a generator circuit-breaker FKG in series with a busbar switch SKG having two switching positions and connected between a generator 1 and a grid transformer 2, together with two grounding switches MALT1 and MALT2, each of which has two switching positions.

In FIG. 6, the generator circuit-breaker FKG and the busbar switch SKG are closed while the grounding switches MALT1 and MALT2 are open. The interlocking rules applicable to these various elements are common both to automatic actuation mode and to manual actuation mode and are as follows.

The busbar switch SKG must not be opened while the generator circuit-breaker FKG is closed. Neither of the grounding switches MALT1 and MALT2 must be closed while the busbar switch SKG is closed. The busbar switch SKG must not be closed while either of the grounding switches MALT1 and MALT2 is closed. The order of operations when actuating the busbar switch SKG and the grounding switches MALT1 and MALT2 starting from the configuration shown in FIG. 6 is as follows. Firstly the generator circuit-breaker FKG must be opened. Thereafter, the busbar switch must be opened, and only after that can each of the grounding switches be closed.

For safety reasons, it is therefore necessary to prevent those switch apparatuses being actuated manually in a manner that does not comply with the above order.

OBJECT AND SUMMARY OF THE INVENTION

The object of the invention is to propose a device using locks to interlock the manual actuation of a switch having a handle inlet, and use locks having keys to authorize the switch to be actuated manually in a certain actuation sequence so as to cause the switch to pass from a first switching position to a second switching position.

According to the invention, the device comprises a first lock and a second lock each operable by means of at least one key capable of being withdrawn from the corresponding lock or of being engaged in said lock only when the lock is in its locked position, a set of cams whose rotation is tied to actuation of the switch and which act on the bolts of said locks to prevent the first lock from being operated so long as the second switch is not in its second switching position and to prevent the second lock being operated by its key as soon as the second switch no longer occupies its first switching position, both locks being disposed in such a manner that their respective bolts, when in the advanced position, close the handle inlet of the switch, the bolt of the first lock being in its retracted position and the bolt of the second lock being in its advanced position when the switch is in its first switching position.

Such an interlock device makes it possible to ensure that manual actuation of the switch is blocked at two levels. In order to be able to actuate a switching apparatus fitted with a device of the invention, it is necessary firstly to actuate the second lock so as to disengage the handle inlet by using a first key which can come from an interlock device associated with a switching apparatus that must be actuated before the switch in question. After the switch has been actuated with the help of the handle so as to cause it to pass into its second switching position, the handle must be removed in order to be able to actuate the first lock. After that operation, manual control of the switch is inhibited, and the key coming from said first lock can be used to unlock another interlock device associated with another switch apparatus that must be actuated manually only after the switch has been actuated. Consequently, with such an interlock device, it is possible to constrain an operator to follow a logical process when manually actuating a set of switch apparatuses.

As explained below, interlocking the switch apparatuses shown in FIG. 6 with a set of interlock devices of the invention requires the use of only seven different keys. By making use of conventional mechanical locks, this device contributes to achieving interlocking of the switch apparatuses in a manner that is reliable, simple, and of low cost. Such a device can easily be adapted to provide interlocking between a generator circuit-breaker and a switch that has three switching positions, the switch possibly also constituting an injection switch.

BRIEF DESCRIPTION OF THE DRAWINGS

The device of the invention is described below in greater detail and is shown in the drawings.

MORE DETAILED DESCRIPTION

Figure 6:
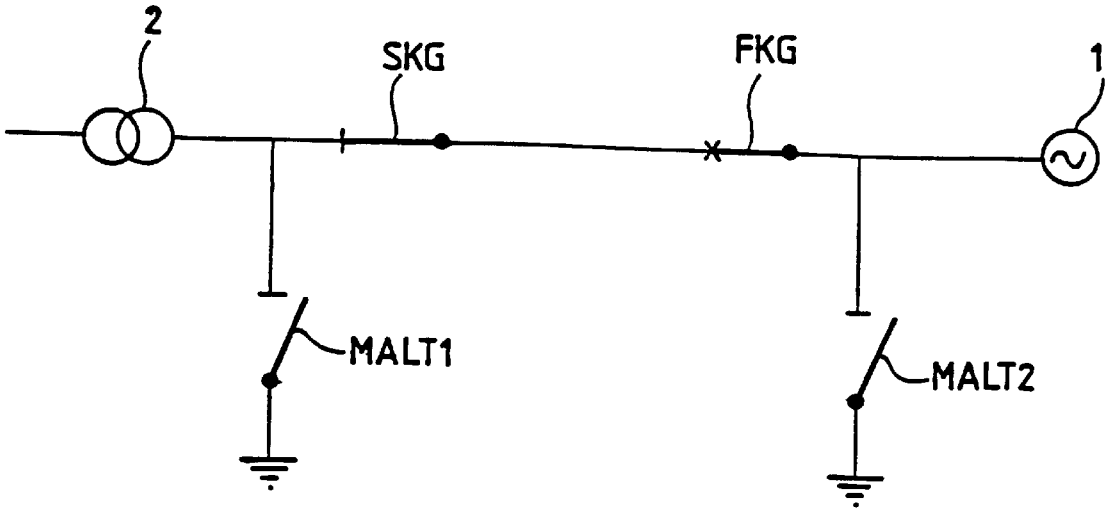
FIG 6 PRIOR ART
FIG. 6 is a simplified circuit diagram of an example of a generator circuit.

FIG. 6 is described above.

Figure 1:
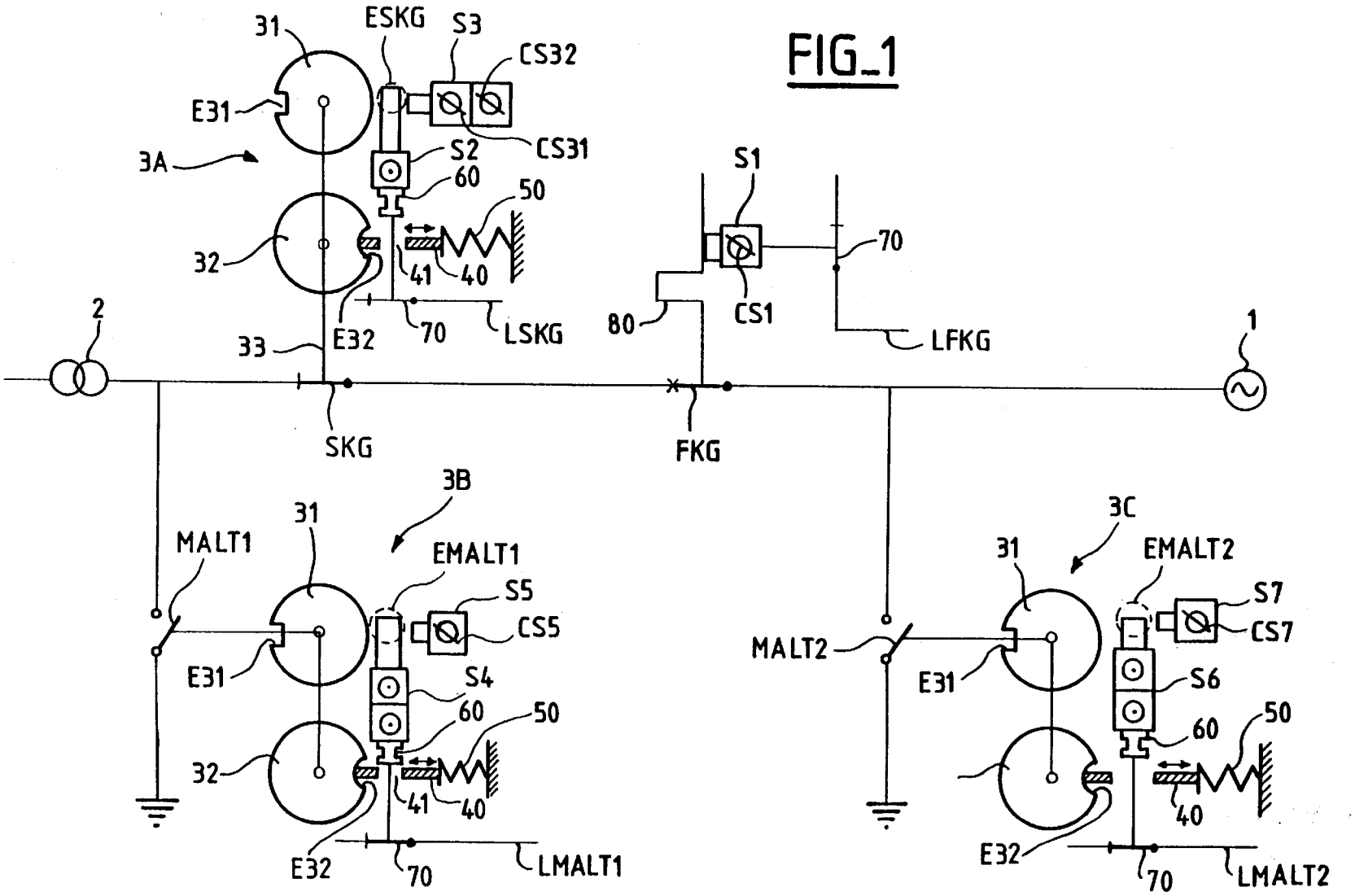
FIG. 1 is a diagram of a first embodiment of a generator circuit including a generator circuit-breaker, a busbar switch having two switching positions, and two grounding switches each having two switching positions, in which the generator circuit-breaker and the busbar switch are closed and the two grounding switches are open, each of the switches being fitted with an interlock device of the invention.

The generator circuit shown in FIG. 1 is identical to that of FIG. 6 and comprises between a generator 1 and a grid transformer 2: a generator circuit-breaker FKG; a busbar switch SKG having two switching positions; and two grounding switches MALT1 and MALT2, each having two switching positions. In FIG. 1, the generator circuit-breaker FKG and the busbar switch SKG are both closed while the grounding switches MALTl and MALT2 are both open.

In this circuit, the circuit-breaker serves to decouple the generator from the grid; the busbar switch SKG serves to isolate the generator from the gird; and the grounding switches MALT1 and MALT2 are connected, one between the grid transformer and the busbar switch, and the other between the generator and the generator circuit-breaker, each serving to drain capacitive electric charge to ground from the grid transformer or from the generator so as to enable maintenance to be performed on those apparatuses in complete safety.

The busbar switch SKG and each of the grounding switches MALT1 and MALT2 is fitted with a respective interlock device 3A, 3B, or 3C of the invention, each interlock device having a respective handle inlet ESKG, EMALT1, and EMALT2.

By way of example, with reference to the interlock device 3A associated with the busbar switch SKG, each interlock device comprises in general terms: two locks such as S2 and S3 each of which is actuated using at least one key such as CS1, CS31, CS32, which key can be withdrawn from the corresponding lock or engaged therein only when the lock is itself locked, i.e. when the bolt of this lock is fully advanced. These two locks are disposed in such a manner that their respective bolts, when in the advanced position, close the inlet for the switch handle such as ESKG.

The device also has a set of cams which rotate in association with the switch being actuated and thus with the displacement of the moving contact of the switch between a first switching position and a second switching position. When the switch is in the first switching position, the bolt of the first lock, such as S3, is in its retracted position, thereby preventing the key such as CS31, CS32 from being withdrawn from said lock, and the bolt of the second lock, such as S2, is in its advanced position, thereby allowing a key to be engaged in said lock, e.g. the key CS1. The bolt of the second lock nevertheless shuts off the handle inlet ESKG of the switch. The set of cams is organized to act on the bolts of the two locks so as to prevent the first lock being actuated by key so long as the switch is not in its second switching position, and to prevent the second lock being actuated by key as soon as the switch is no longer in its first switching position.

The two locks are prevented from operating in particular by a set of cams which comprises, with reference to the interlock device 3A associated with the switch SKG: a first cam 31 having a notch E31 in which the bolt of the first lock S3 can be engaged when it is in its advanced position. Consequently, so long as the notch E31 is not facing the bolt of the lock S3, the lock S3 cannot be actuated. The set of cams also has a second cam 32 having a notch E32 (preferably a semicircular notch) in which it is possible to engage a plate 40 which is movable in translation perpendicularly to the bolt of the second lock S2. Rotation of both of these cams 31 and 32 is associated with the switch being actuated, and both cams are linked to rotate together (e.g. by a set of gears) as represented by the line 33 interconnecting the axes of rotation of the two cams 31 and 32 and the moving contact of the switch SKG.

The plate 40 is subjected to a return force directed in its translation displacement direction, said return force being exerted, for example, by a compression spring 50. This return force tends to urge the plate 40 against the cam 32. The bolt of the second lock S2 is a through bolt whose rear end has a groove 60 and which can engage itself in a hole 41 provided in the plate 40. When the notch E32 of the cam 32 faces the plate 40, the hole 41 therein faces the rear end of the through bolt of the second lock S2. The second lock can thus be actuated so as to release the handle inlet ESKG at the same time as the rear end of the through bolt of the lock S2 engages in the hole of the plate 40. When the notch E32 of the cam 32 is not facing the plate 40 while the rear end of the through bolt of the second lock S2 is engaged in the hole 41 of the plate 40, the cam 32 pushes back the plate 40 which engages in the groove 60 of the through bolt, thereby preventing the second lock from being actuated. The interlock device 3A is of relatively compact design if the two cams 31 and 32 are superposed parallel to the through bolt of the second lock S2 and if the bolt of the first lock S3 extends perpendicularly to the bolt of the first lock S2.

By being moved, the through bolt of the second lock S2 also controls a contact 70 designed to open or close a power supply line LSKG for electrical control of the switch SKG. This contact 70 is normally open while the switch is being actuated manually so as to prevent electrical waves being reflected into the electrical control for the switch SKG and disturbing the manual operation of the switch.

The interlock devices 3B and 3C associated with the grounding switches MALT1 and MALT2 are analogous to the device 3A associated with the switch SKG as described above, and elements in these devices which are identical thereto are given the same references.

In the generator circuit diagram of FIG. 1, the first interlock device 3A associated with the switch SKG has a first lock S3 with two keyholes and with two keys CS31 and CS32, and a second lock S2 having a single keyhole; the second interlock device 3B associated with the switch MALT1 has a first lock S5 with one keyhole and a key CS5, and a second lock S4 having two keyholes, and the third interlock device C3 associated with the switch MALT2 has a first lock S7 with one keyhole and a key CS7, and a second lock S6 with two keyholes.

In addition, in the generator circuit-breaker FKG, there is provided another lock S1 having one keyhole with a key CS1, operation of the key CS1 being blocked so long as the generator circuit-breaker is not open. In particular, the lock S1 is mounted facing a rod 80 having a setback in which the bolt of the lock S1 can engage only when the generator circuit-breaker is open. The rod 70 is movable in translation perpendicularly to the bolt of the lock S1 when the generator circuit-breaker is itself actuated.

In the initial state of the generator circuit, prior to changing over to manual control mode, the generator circuit-breaker is closed, the switch SKG occupies a first switching position corresponding to a closed state, and both grounding switches MALT1 and MALT2 occupy respective first switching positions corresponding to an open state.

Figure 2:
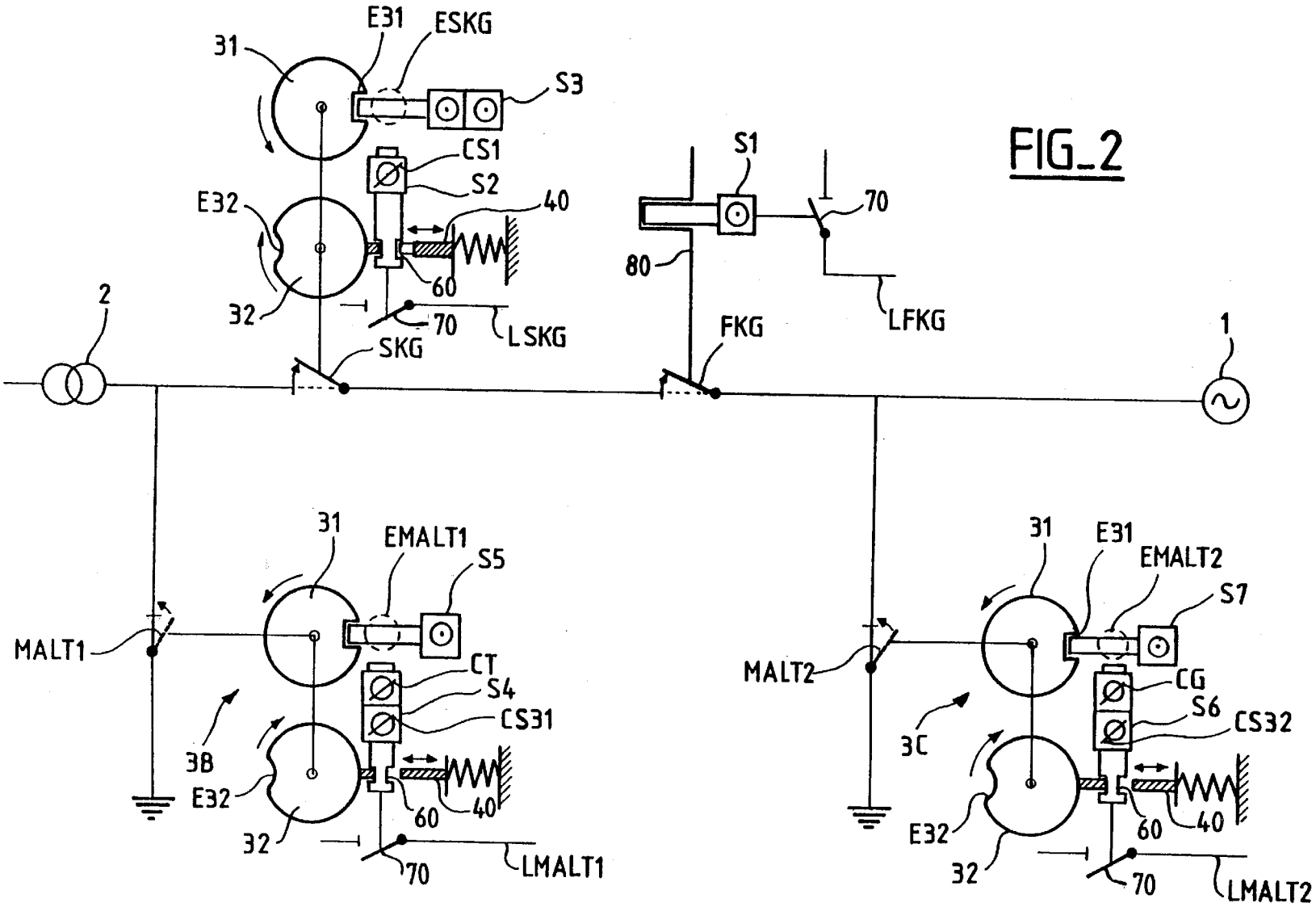
FIG. 2 shows the FIG. 1 generator circuit with the interlock devices of the invention when the generator circuit-breaker and the busbar switch are open and the two grounding switches are closed.

Manual actuation of these apparatuses should lead to the generator circuit occupying the state shown in FIG. 2 in which the generator circuit-breaker FKG and the busbar switch SKG are both open and in which the grounding switches MALT1 and MALT2 are both closed.

To change the state of the generator circuit from that shown in FIG. 1 to that shown in FIG. 2, the operator must proceed as follows.

The generator circuit-breaker FKG is opened, e.g. by pressing a pushbutton, thereby causing the setback in the rod 80 to face the bolt of the lock S1. The lock S1 is locked by turning the key CS1, thereby causing the bolt of the lock S1 to engage in the setback of the rod 80 and causing the power supply line LFKG for automatically controlling the circuit-breaker to be opened by means of the contact 70 which is constrained to move together with the bolt of the lock S1. The key CS1 is withdrawn from the lock S1, thereby blocking manual actuation of the circuit-breaker FKG.

Thereafter, the key CS1 is engaged in the keyhole of the lock S2 of the interlock device 3A and the lock S2 is locked by actuating the key CS1 causing the handle inlet ESKG to be released. Simultaneously, the rear end of the through bolt of the lock S2 engages in the plate 40 of the device 3A and the displacement of the bolt of the lock S2 opens the power supply line LSGK for automatic control of the switch SKG. It should be observed that at this stage in the manual actuation of the switch SKG, the plate 40 is engaged in the notch E32 of the cam 32 while the notch E31 is in a position that is diametrically opposite from the bolt of the lock S3. The switch SKG is opened by means of the handle, thereby causing the cams 31 and 32 of the device 3A to rotate through 180°. From the start of its rotation, the cam 32 pushes away the plate 40 which engages in the groove 60 of the bolt of the lock S2, thereby blocking the key CS1 in the lock S2. Furthermore, the notch E31 of the cam 31 comes to face the bolt of the lock S3 once the switch SKG is fully open. The handle is withdrawn from the handle inlet ESKG and the two keys CS31 and CS32 are turned so as to lock the lock S3, thereby causing the handle inlet ESKG to be closed by the bolt of the lock S3, thereby preventing the switch SKG from being actuated. Each of the keys CS31 and CS32 can then be withdrawn from the lock S3.

To close the grounding switch MALT1, the operator engages the key CS31 in one of the two keyholes of the lock S4 of the device 3B and engages another key CT coming from a key interlock system associated with the transformer into the other keyhole of the lock S4. This key CT which is taken to the grounding switch MALT1 must be suitable for certifying that the transformer has indeed been decoupled from the grid.

The keys CT and CS31 are actuated to unlock the lock S4, thereby releasing the handle inlet EMALT1 of the switch MALT1. Simultaneously, the rear end of the through bolt of the lock S4 engages in the plate 40 of the device 3B and by its displacement controls the contact 70 of the device 3B, thereby opening the power supply line LMALT1 for automatic control of the switch MALT1. The switch MALT1 is closed manually using the handle, and the handle is then withdrawn from the handle inlet EMALT1. From the beginning of the switch MALT1 being actuated manually, the cam 32 of the device 3B pushes the plate 40 of the device 3B into the groove 60 of the through bolt of the lock S4, thereby blocking the keys CT and CS31 in the lock S4. When the switch MALT1 is fully closed, the notch E31 of the cam 31 of the device 3B faces the bolt of the lock S5. The lock S5 is locked by turning the key CS5, thereby closing the handle inlet EMALT1. Thereafter, the key CS5 is put back in the key interlock system of the transformer to certify that the grounding switch MALT1 is closed and that it is possible to take action on the transformer.

To close the grounding switch MALT2, the operator then engages the key CS32 in one of the two keyholes of the lock S6 of the device 3C and inserts another key CG coming from a key interlock system associated with the generator in the other keyhole of the lock S6. This key CG which is applied to the grounding switch MALT2 must be of a kind suitable for certifying that the generator is no longer live.

The keys CG and CS32 are actuated so as to unlock the lock S6 which releases the handle inlet EMALT2 of the switch MALT2. Simultaneously, the rear end of the through bolt of the lock S23 engages in the plate 40 of the device 3C and, by means of the contact 70, displacement thereof serves to open the power supply line LMALT for automatically controlling the switch MALT2. The switch MALT2 is closed manually using the handle and the handle is withdrawn from the handle inlet EMALT2. From the beginning of the switch MALT2 being actuated manually, the cam 32 of the device 3C pushes the plate 40 into the groove 60 of the through bolt of the lock S6, thereby blocking the keys CG and CS32 in the lock S6. When the switch MALT2 is fully closed, the notch E31 of the cam 31 of the device 3C faces the bolt of the lock S7. The lock S7 is locked by turning the key CS7, thereby closing the handle inlet EMALT2. The key CS7 is then returned to the key interlock system of the generator to certify that the grounding switch MALT1 is closed and that it is possible to take action on the generator.

It can thus be seen that the interlock system which uses three interlock devices of the invention requires only seven different keys for the generator circuit shown in FIGS. 1 and 2.

The generator circuit is returned to the initial state shown in FIG. 1 by using the keys in the opposite order to that described above.

Figure 3:
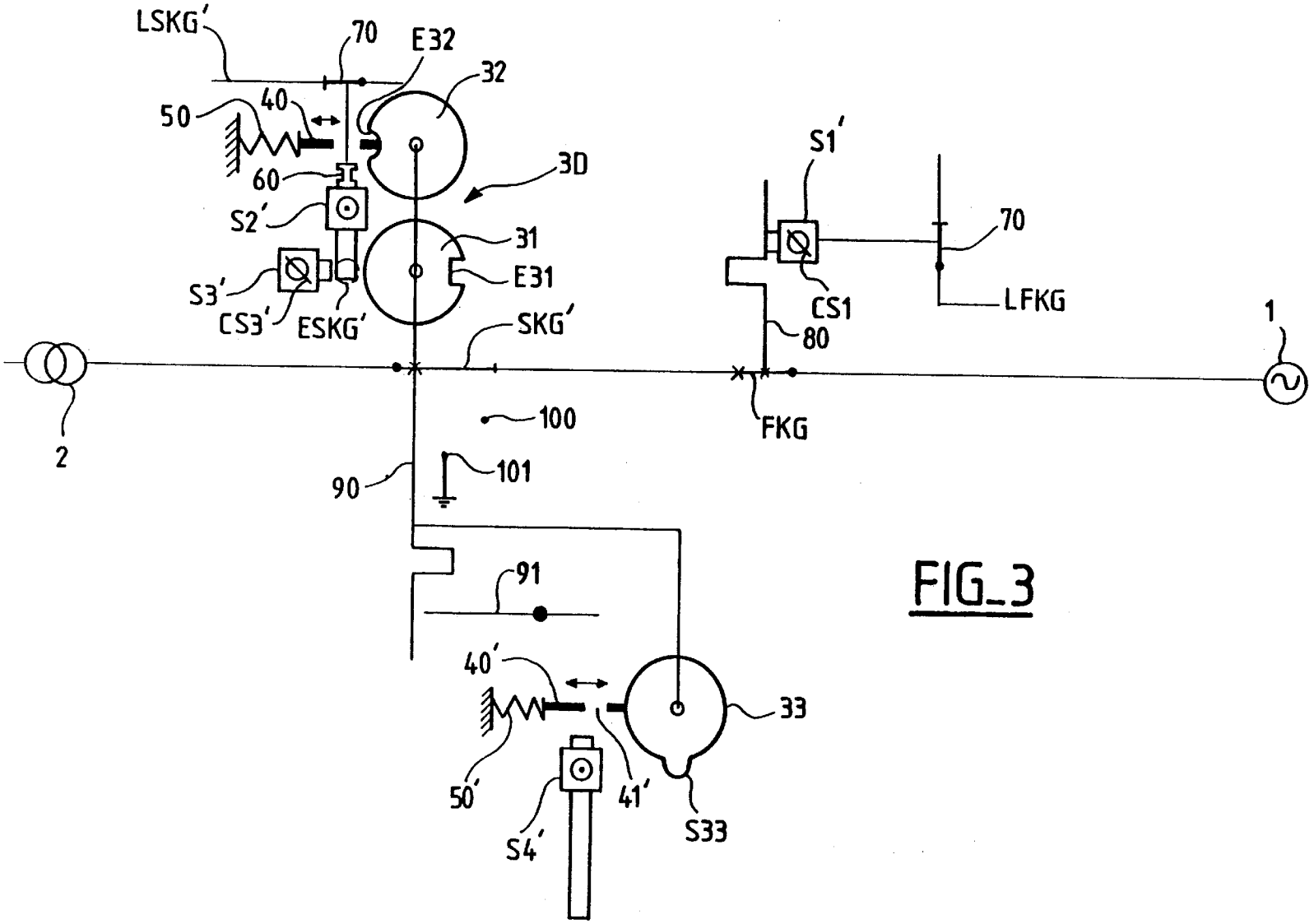
FIG. 3 is a diagram showing a second example of a generator circuit including a generator circuit-breaker and a switch having three switching positions, with one of the three switching positions being a grounding position, in which the generator circuit-breaker and the switch are closed, the switch being fitted with an interlock device of the invention.

In FIG. 3, an interlock device 3D of the invention locks manual control of a three-position switch SKG' mounted in a generator circuit in series with a generator circuit-breaker FKG between a generator 1 and a grid transformer 2. The switch SKG1 serves both as a busbar switch when it is in its switching position referenced 100, and as a grounding switch when it is in its switching position referenced 101.

The interlock device 3D is analogous to the device 3A as described for the switch SKG with the exception that each of its two locks S2' and S3' has a single keyhole, and rotation of the cams 31 and 32 also causes a rod 90 having a setback to be displaced and causes another cam 33 having a projection S3 to be rotated. The setback of the rod 90 co-operates with a lever arm 91 forming a moving abutment, which lever is actuated by the bolt of a lock S4' that can be actuated by means of a key and which has a through bolt whose rear end includes a groove 61 which co-operates with a plate 40' that is movable in translation perpendicularly to the bolt of the lock S4', said plate 40' having a hole 41' in which the rear end of the bolt of the lock S4' can engage. The plate 40' is urged to move in the direction perpendicular to the bolt of the lock S4' both by means of a compression spring 50' and a cam 33 in a manner that is analogous to the plate 40 of the device 3A.

In FIG. 3, when the generator circuit is in its initial state, the generator circuit-breaker FKG is closed, and the switch SKG' is closed onto the set of busbars. When these devices are actuated manually, they must cause the generator circuit to take up the state shown in FIG. 4 in which the generator circuit-breaker SKG is open and the switch SKG' is in a third switching position corresponding to grounding.

To cause the generator circuit to go from the state shown in FIG. 3 to that shown in FIG. 4, the operator should proceed as follows.

As mentioned above, the generator circuit-breaker FKG is opened by pressing on the pushbutton, thereby causing the setback in the rod 80 to take up a position facing the bolt of the lock S1. The lock S1 is locked by turning the key CS1, thereby causing the bolt of the lock S1 to engage in the setback of the rod 80, and simultaneously opening the power supply line LFKG for automatic control of the circuit-breaker by means of the set of contacts 70 moved together with the bolt of the lock S1.

The key CS1 is removed from the lock S1, thus preventing the circuit-breaker FKG from being actuated.

The key CS1 is then engaged in the keyhole of the lock S2' of the device 3D and the lock S2' is locked by actuating the key CS1, thereby releasing the handle inlet ESKG'. Simultaneously, the rear end of the through bolt of the lock S2' engages in the plate 40 of the device 3D and the displacement of the bolt of the lock S2' causes the power supply line LSKG' for automatic control of the switch SKG' to be opened by means of the contact 70. The switch SKG' is actuated using the handle so as to take up a second switching position given reference 100 and corresponding to being in an open state. When the switch is actuated, this causes the cams 31 and 32 to perform a first rotation through 90°. From the beginning of this rotation, the cam 32 pushes back the plate 40 which engages in the groove 60 of the bolt of the lock S2', thus blocking the key CS1 in the lock S2'. During this first move of the switch, the notch E31 of the cam 31 of the device 3D does not come to face the bolt of the lock S3', as can be seen in dashed lines in FIG. 4. During this first move of the switch SKG', the 90° rotation of the cams 31 and 32 causes the rod 90 to move in translation so that the setback in the rod 90 comes into abutment against the lever 91, thereby blocking the switch in an open position. Simultaneously, the cam 33 turns through 90° so that the projection S33 pushes the plate 40' so that the hole 41' in the plate 40' faces the through bolt of the lock S4'.

To cause the switch SKG' to pass from its second switching position to its third switching position which corresponds to a grounding position as referenced 101, the operator must have available a key CT coming from a key interlock system associated with the transformer. This key CT which is brought to the switch having three switching positions must be of a kind suitable for certifying that the transformer is indeed decoupled from the grid. The key CT is engaged in the keyhole of the lock S4' to unlock it. When the key CT is used to operate the lock S4', the rear end of the through bolt of the key S4' is extended so as to engage in the hole 41' of the plate 40' and act on the lever arm 91 so that it is retracted in front of the setback in the rod 90. It should be observed that it is necessary to provide an electromagnet EM between the rear end of said bolt and the lever arm 91 so as to cause the lever arm 91 to be withdrawn to pass from the second switching position to the third switching position when the switch is actuated under electrical control instead of by key in manual mode.

Thereafter, the switch is actuated again using the handle so as to cause it to pass into its third switching position and the handle is withdrawn from the handle inlet ESKG'. From the beginning of this move, the projection S33 of the cam 33 releases the plate 40' which then engages in the groove 60' of the bolt of the lock S4', thereby causing it to be blocked, and the key CT can no longer be withdrawn from the lock S4'.

When the switch SKG' occupies its grounding position, the notch E31 of the cam 31 faces the bolt of the lock S3. The key CS3' can be actuated to lock the lock S3' and close the handle inlet ESKG'. Thereafter, this key CS3' is returned to the key interlock system of the transformer to certify that the switch SKG' is in its grounding position and that it is possible to take action on the transformer.

Figure 5:
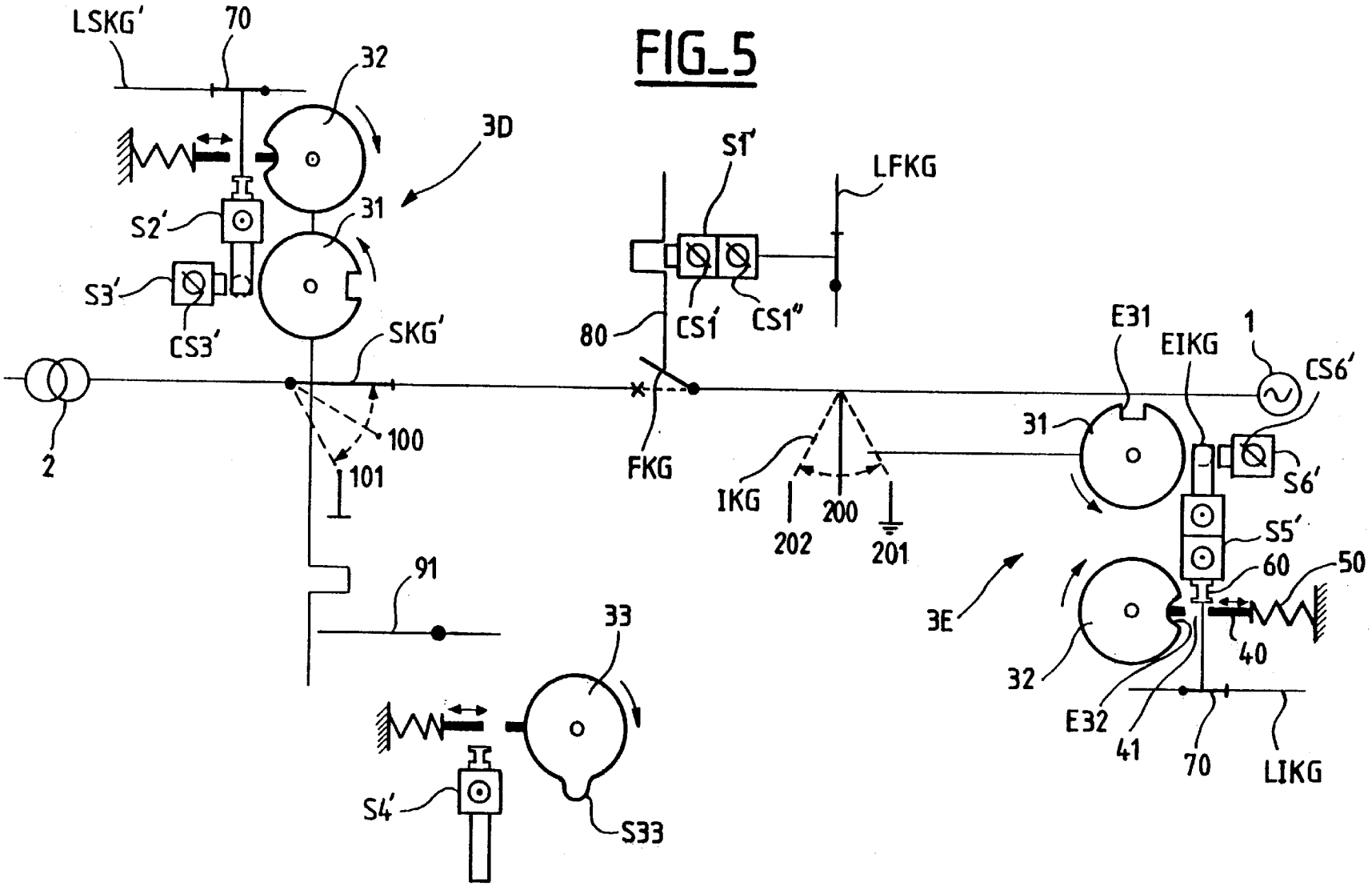
FIG. 5 shows the FIG. 3 generator circuit further including an injection and grounding switch having three switching positions and fitted with an interlock device of the invention.

FIG. 5 shows yet another example of a generator circuit including between the generator 1 and the grid transformer 2 a generator circuit-breaker FKG in series with a switch SKG' having three switching positions including a grounding position, and a grounding switch IKG having three switching positions including a grounding open position referenced 200, a grounding closed position referenced 201, and a closed position for a starter circuit referenced 202.

Figure 4:
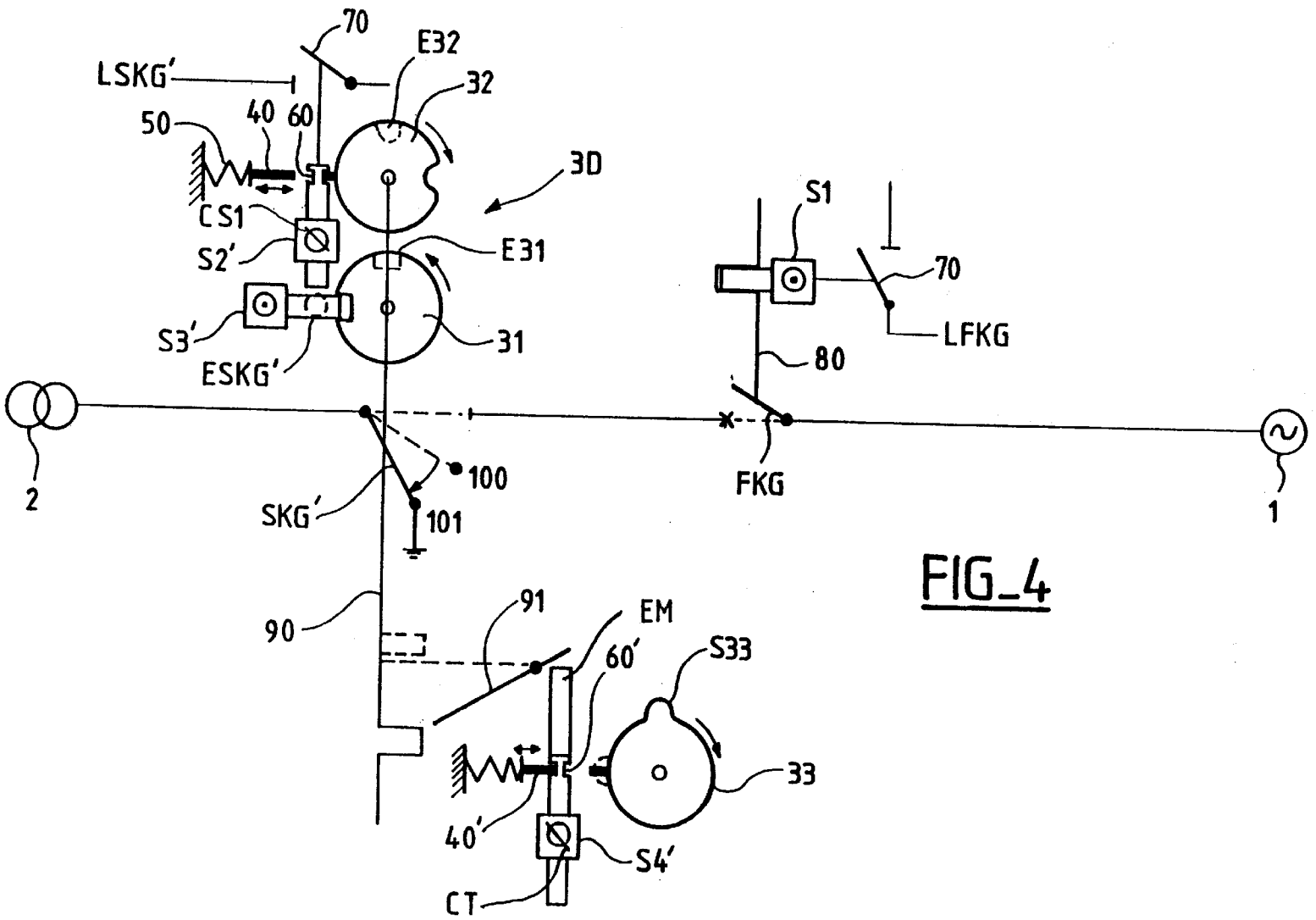
FIG. 4 shows the FIG. 3 generator circuit with the interlock device of the invention when the generator circuit-breaker is open and the switch is occupying its grounding position.

As can be seen in FIG. 5, the interlock device 3D associated with the switch SKG' is identical in design and operation to that shown in FIGS. 3 and 4.

The interlock device 3E associated with the switch IKG comprises a first lock S5' having two keyholes and a through bolt whose rear end is provided with a groove 60 which co-operates with a plate 40 having a hole 41. Movement of the through bolt also acts on a contact 70 which opens or closes the power supply line LIKG for automatic control of the switch IKG. The plate 40 is urged in a direction perpendicular to the through bolt of the lock S5' by a spring 50 and by a cam 32 having a notch E32 in which the plate 40 can engage. The device 3E also has a second lock S6' having a keyhole and a second cam 31 having a notch E31 in which the bolt of the lock S6' can engage. The bolts of the two locks S5' and S6' are also disposed so as to be capable, when in the advanced position, of closing the handle inlet EIKG of the switch IKG.

The lock S1' associated with the generator circuit-breaker also has two keyholes with two keys CS1' and CS1".

In manual control mode, the switch SKG' is opened and grounded in a manner that is identical to that described above with reference to FIGS. 3 and 4 by using the key CS1' instead of the key CS1.

Starting from the configuration shown in FIG. 5 in which the generator circuit-breaker FKG is open and the grounding switch IKG occupies its first switching position 200, the switch is actuated into its second switching position 201 as follows. The lock S1' associated with the circuit-breaker FKG is locked, e.g. by turning the key CS1", causing the bolt of this lock to engage in the setback of the rod 80 that blocks manual actuation of the circuit-breaker into the open position.

The key CS1" is then withdrawn from the lock S1' and is engaged in one of the two keyholes of the lock S5'. Another key coming from the key interlock system of the generator is engaged in the other keyhole of the lock S5' and these two keys are turned in order to unlock the lock S5'. The movement of the bolt of the lock S5' causes the line LIKG for powering the grounding switch IKG to be opened by means of the contact 70. The handle inlet EIKG of the grounding switch IKG is released, and the grounding switch is actuated so as to take up its switching position 201. When the switch IKG is actuated manually, the cams 31 and 32 of the device 3E are rotated through 90° so that the notch E31 faces the bolt of the lock S6' while the cam 32 pushes back the plate 40 in the groove 60 of the bolt of the lock S5'. The handle is withdrawn from the handle inlet EIKG and the lock S6' is locked by means of the key CS6' which is then withdrawn and returned to the key interlock system of the generator to certify that it is possible to work thereon.

What is claimed is:

1. An interlock device using locks to prevent manual actuation of a switch having a handle inlet, and to allow the switch to be actuated manually in a certain sequence of operations determined by using keys for the locks, thereby enabling the switch to pass from a first switching position to a second switching position, the device comprising a first lock having a first bolt and a second lock having a second bolt each operable by means of at least one key capable of being withdrawn from a corresponding one of the first lock and the second lock or of being engaged in the corresponding lock only when the corresponding lock is in a locked position, a set of cams whose rotation is tied to actuation of the switch, said cams acting on the first and second bolts of said first and second locks, respectively, to prevent the first lock from being operated so long as a second switch is not in a second switching position and to prevent the second lock from being operated by the at least one key as soon as the second switch no longer occupies a first switching position, both the first lock and the second lock being disposed in such a manner that the first and second bolts, respectively, when in an advanced position, close the handle inlet of the switch, the first bolt of the first lock being in a retracted position and the second bolt of the second lock being in the advanced position when the switch is in the first switching position.

2. The device of claim 1, in which the second lock has a through-bolt and the set of cams comprises a first cam having a notch in which the first bolt of the first lock can engage in the advanced position, a second cam having a notch in which a plate that moves in translation in a direction perpendicular to the through-bolt of the second lock can engage, a resilient element exerting a return force along said direction tending to urge said plate against the second cam, said plate co-operating with a rear of the through-bolt of the second lock to authorize or prevent the second lock from being operated by the at least one key, depending on whether or not said plate is engaged in the notch of the second cam.

3. The device of claim 2, in which the through-bolt of the second lock upon moving controls a contact designed to close or open a power supply line of an electrical control of the switch.

4. The device of claim 1, in which the first lock is operated using two different keys.

5. The device according to claim 1, in which the second lock is operated using two different keys.

6. A generator circuit comprising a busbar switch having two switching positions, and two grounding switches each having two switching positions, and in which manual actuation of each of said switches is prevented by a device according to claim 1, wherein the interlock device preventing manual switching of said busbar switch includes the first lock operated by two different keys, and the interlock device preventing manual actuation of each of said two grounding switches includes the second lock operated using two different keys.

7. A generator circuit comprising a switch having three switching positions, wherein one of the three switching positions is a grounding position, and in which manual actuation of the switch having the three switching positions is prevented by a device according to claim 1.

8. A generator circuit comprising a grounding switch having three switching positions, wherein one of the three switching positions is a grounding position, and in which manual actuation of the grounding switch is prevented by a device according to claim 1 in which the second lock is operated using two different keys.

* * * * *